United States Patent [19]

Meneely

[11] Patent Number: 4,655,178

[45] Date of Patent: Apr. 7, 1987

[54] ANTI-LASH ADJUSTER

[76] Inventor: Vincent A. Meneely, 9837 McKinnon, R.R. No. 10, Langley, British Columbia, Canada, V3A 6X5

[21] Appl. No.: 732,164

[22] Filed: May 8, 1985

[51] Int. Cl.[4] ..... F02D 9/06

[52] U.S. Cl. ..... 123/321; 123/90.16

[58] Field of Search ..... 123/321, 347, 90.12, 123/90.16, 198 DB

[56] References Cited

U.S. PATENT DOCUMENTS

| | | | |
|---|---|---|---|
| 4,398,510 | 8/1983 | Custer | 123/321 |
| 4,399,787 | 8/1983 | Cavanagh | 123/321 |
| 4,475,500 | 10/1984 | Bostelman | 123/321 |

*Primary Examiner*—William A. Cuchlinski, Jr.
*Attorney, Agent, or Firm*—Seed and Berry

[57] ABSTRACT

An anti-lash adjuster for compression relief brakes on internal-combustion engines. The anti-lash adjuster has a slave piston adapted to contact the valve-actuating mechanism for the exhaust valves. The slave piston has a predetermined surface area and a retracting spring which biases the slave piston to a retracted position. A forward bias unit is provided to assist oil under engine-oil pressure in overcoming the retracting force to bias the slave piston to an extended position. The forward bias unit only assists the engine-oil pressure in overcoming the retracting force over a limited distance. The distance may be selected to keep the exhaust valves open throughout brake operations or only to take up the lash during brake operation or to take up part of the lash. A master piston is provided to further open the valves during portions of brake operation.

10 Claims, 1 Drawing Figure

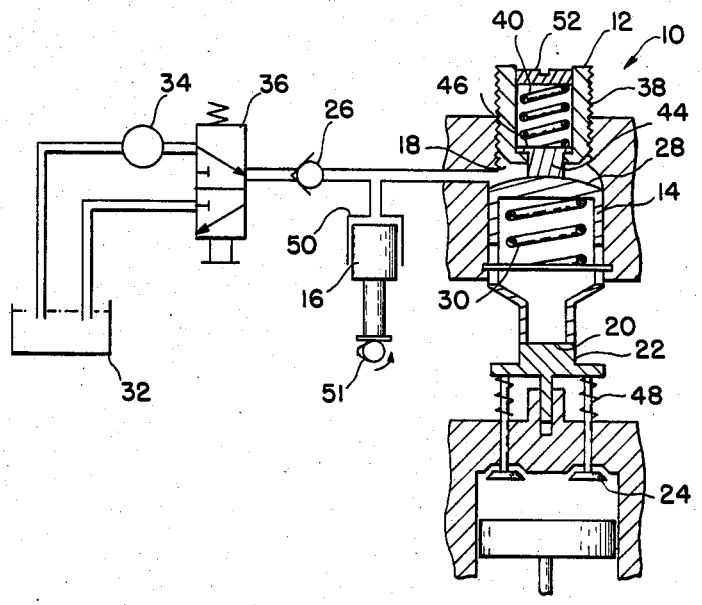
40
52
12
10
34
36
46
38
26
44
18
28
14
50
16
30
20
22
32
51
48
24

ANTI-LASH ADJUSTER

DESCRIPTION

1. Technical Field

The invention relates to an apparatus for compression relief in an internal-combustion engine for braking the engine. Specifically, the invention relates to an improved apparatus for assisting engine oil pressure to position a slave piston for compression relief braking.

2. Background Art

A variety of methods have been employed to utilize the compression of an internal-combustion engine for braking when a vehicle is moving down a grade. One such method is disclosed by Custer in U.S. Pat. No. 4,398,510. In the device disclosed in the Custer patent, the exhaust valves of an internal-combustion engine are opened at a point in the compression stroke when they would normally remain closed.

To ensure proper operation of an internal-combustion engine, a minimum cold clearance, typically on the order of 0.018 inch, is maintained in the valve-actuating mechanism of the engine. This clearance is necessary to prevent premature opening of the exhaust valves when the engine becomes hot. The improvement disclosed by Custer is an anti-lash timing mechanism which takes up this cold clearance during brake operation to improve the opening and closing of the exhaust valves during the various cycles of the engine. The timing mechanism of Custer displaces a slave piston to take up the cold clearance when the brake is in operation so that a high-pressure pulse of engine oil from a master piston driven off a fuel injector camshaft can open the exhaust valves at the appropriate time.

The Custer timing mechanism, however, is too complex. The mechanism employs two coaxial springs, a ball check valve within an inner closely fitting piston, and various pins to limit the degree of lash take-up. This structure is necessary to axially extend and lock the piston in its extended position. Thus, a need exists for a different compression relief brake operating mechanism which can control the operation of the exhaust valves during brake operation with a minimum of moving parts and close tolerances.

DISCLOSURE OF THE INVENTION

It is an object of the invention to provide a compression relief brake operating mechanism having a simplified construction.

The invention achieves these and other objects which will become apparent in the description which follows by providing a compression relief brake having a forward bias unit which assists engine oil pressure in displacing a slave piston to take up cold clearance or lash between the slave piston and the exhaust valves and to keep the exhaust valves open during the operation of the brake. The forward bias unit has a loose tolerance finger having a limited extension so that an assist force is applied to the surface of the slave piston over a distance limited to the extension of the loose tolerance finger. The slave piston has a return spring and a predetermined surface area so that the application of engine oil under engine oil pressure alone cannot displace the slave piston. However, engine oil pressure in combination with the supplemental force from the loose tolerance finger can bias the slave piston to an extended position. As determined by the length of the limited extension of the finger, the slave piston can be biased to a position which takes up cold clearance so that a pulse of high-pressure oil from a master piston will open the exhaust valves at a predetermined time and so that the valves can be kept opened throughout the brake action.

When the brake is activated, the normal operation of the valve camshaft fully opens the exhaust valves during the exhaust stroke. The slave piston is pushed toward the valve by engine oil pressure and the supplemental force from the forward bias unit, causing the slave piston to follow the exhaust valves to the limit of the extension of the loose tolerance finger. Oil trapped within the oil line between the oil pump and the slave piston locks the slave piston in its extended position to the limit of the loose tolerance finger extension to keep the exhaust valves slightly open. An additional pulse of high-pressure oil from the master piston can further open the exhaust valves at any desired time, such as just prior to top dead center, to provide extra exhaust flow, for example, during a compression stroke.

In one embodiment, the loose tolerance finger has an extension limit of 0.030 inch to keep the exhaust valves slightly open throughout the operation of the compression brake when the invention is used on a vehicle having a typical cold clearance between the slave piston and the exhaust valves of 0.018 inch.

BRIEF DESCRIPTION OF THE DRAWING

FIG. 1 is a schematic and diagrammatic representation of a compression relief brake employing the present invention.

BEST MODE FOR CARRYING OUT THE INVENTION

A compression relief brake, in accordance with the present invention, is generally indicated at reference numeral 10 in FIG. 1. The brake is shown in a braking mode. The brake has a forward bias unit 12, a slave piston 14, and a master piston 16.

The slave piston 14 is mounted for reciprocating motion in a fluid cavity 18. One end 20 of the slave piston is adapted to contact the cross-head 22 or other operating means for the exhaust valves 24 of an internal-combustion engine.

A check valve, represented at reference numeral 26, allows engine oil under engine oil pressure to enter the fluid cavity 18. Once oil enters the fluid cavity through the check valve, the oil is trapped within the cavity and can only exit the cavity by bleeding through the check valve relatively slowly.

The slave piston 14 has a predetermined surface area 28 which in the preferred embodiment is equal to approximately 0.785 square inch. A return spring 30 biases the slave piston to a retracted position under a predetermined retracting force of approximately 70 lbs. throughout the expected motion of the slave piston. This force is sufficient to prevent engine oil within the fluid cavity 18 under normal engine oil pressure from displacing the piston. Engine oil is supplied from sump 32 by engine oil pump 34 at a pressure of about 35 psig to the check valve 26 through a solenoid-operated control valve 36. Thus, the downward force acting on the predetermined surface area of the slave piston from oil pressure alone is approximately 27 lbs.

The forward bias unit 12 provides a supplemental force to the surface of the slave piston to assist the engine oil pressure in overcoming the retracting force of the return spring. The forward bias unit has a threaded housing 38 containing a compression spring 40 and a loose tolerance finger 44. The loose tolerance finger is mounted for reciprocating motion within the threaded housing and has an outer end which can protrude from the housing in an extended position and which can retract into the housing. The outer end is adapted to contact the surface 28 of the slave piston. The inner end or top of the finger has a flange 46 to limit the amount of outward extension of the finger. In the alternative, rather than have a flange on the top of the finger 44, the finger can be a continuous cylinder with a pin passing diametrically through the finger near the top of the finger to limit the amount of outward movement of the finger. The spring 40 rests on the pin rather than the flange in such an alternative embodiment. The compression spring exerts a minimum force against the finger when the finger is in the extended position and a maximum force when in the retracted position.

For proper operation of the brake, the maximum force of the compression spring 40 cannot exceed the retracting force of the return spring 30 within the slave piston, so that when the compression brake is deactivated and oil pressure in line 18 decreases, the net resultant force acting on the slave piston overcomes the force on finger 44 and biases the slave piston to the retracted position. The minimum force of the compression spring must be sufficient to provide a net resultant force, which is a combination of the force due to engine-oil pressure acting on the predetermined surface of the slave piston and the minimum force due to the extended compression spring, such that the slave piston is biased to its extended position when the brake is activated. Thus, for this embodiment, a compression spring having a minimum compressive force of more than 43 lbs. and a maximum compression force of less than 70 lbs. over a distance equal to the length of the extended portion is preferred. In practice, a compression spring having maximum and minimum compressive forces of 70 lbs. and 50 lbs., respectively, has been found to operate satisfactorily. By substituting different length fingers, the finger can be varied to alter the amount of extension of the finger.

Typically, a clearance of 0.018 inch exists between the end of the slave piston 20 and the cross-head 22 when the engine is cold. This clearance is required to allow for thermal expansion of the exhaust valves 24 when the valves are brought up to engine operating temperature. The clearance between the end of the slave piston and the cross-head must slightly exceed the expected linear expansion of the exhaust valves so that the exhaust valves are not open throughout the normal operation of the engine when the compression brake is not in effect. To operate the brake, it is desirable to take up this cold clearance or lash so that the exhaust valves can be held open during the engine cycles.

By providing the extended portion of the loose tolerance finger 44 with a length of 0.030 inch, the exhaust valves 24 will always remain in a slightly cracked or open position when engine oil under engine oil pressure is present within the fluid chamber 18. The length of the finger can be made smaller to merely take up some of the cold clearance but not keep the valves open continuously during the brake operation or can be made longer to crack open the valves a greater amount.

The compression spring 40 can have a minimum compressive force of 50 lbs. when in the extended position, providing a net forward bias force on the slave piston of only about 7 lbs. Although this force is not sufficient to displace the exhaust valves because of compression in the engine cylinders and valve return spring force, the normal operation of the valve camshaft will open the exhaust valves against these forces during the exhaust stroke. The slave piston will move downwardly to the extent of the protruding finger and an additional increment of engine oil will enter the fluid cavity 18 behind the slave piston 14. The slave piston, however, will only extend a distance equal to the length of the extended portion since the supplemental force only operates as long as the loose tolerance finger and slave piston are in contact. The extra increment of oil which is now trapped in the fluid cavity by the valve 26 will prevent the valve spring 48 from retracting the slave piston after the valve camshaft has released the exhaust valves. Thus, the slave piston 14 will not return to its retracted or normal brake-off position until the control valve 36 is deactivated.

The master piston 16 provides a high-pressure pulse of oil which enters the fluid cavity to open the exhaust valves near the end of the compression stroke. The master piston reciprocates in a master cylinder 50 which communicates with the fluid cavity 18. The master piston can be driven off a fuel injection camshaft 51 which can be adjusted to pulse the master piston appropriately.

The forward bias unit is provided with the threaded housing 38 so that the cold clearance of the brake 10 can be adjusted.

The compressive force of the compression spring 40 can be controlled by rotating an adjustable plug 52.

It will be appreciated that other embodiments and variations of the invention are also contemplated. For example, the forward bias unit need not be positioned above the slave piston as illustrated. The forward bias unit could be incorporated into the slave piston to react against the surface of the fluid cavity. Furthermore, the construction of the forward bias unit could be even further simplified by eliminating the threaded housing 38 and the loose tolerance finger and employing only an adjustable compression spring 40 which has a limited length of travel. Thus, the scope of the invention is not to be limited by the above description, but is to be determined by the scope of the claims which follow.

I claim:

1. A compression relief engine brake for internal-combustion engines, comprising:

an engine having an engine oil pump, exhaust valves, and means for actuating the exhaust valves;

a fluid cavity for accepting engine oil under engine oil pressure;

means for supplying engine oil under normal pressure to the fluid cavity;

a slave piston having a predetermined surface area exposed to the fluid cavity, mounted for reciprocating motion within the fluid cavity, wherein the slave piston has a retracted position defining a maximum clearance between one end of the slave piston and the exhaust valve actuating mechanism and an extended position for reducing the clearance between the end of the slave piston and the exhaust valve actuating mechanism;

means for biasing the slave piston to the retracted position under a predetermined retracting force sufficient to prevent extension of the slave piston upon application of the engine oil at normal pressures to the fluid cavity;

means for applying a supplemental force which does not exceed the predetermined retracting force over a limited distance to the surface of the slave piston wherein the resultant force due to the force imposed by oil pressure within the fluid cavity acting on the predetermined surface area of the slave piston and the supplemental force exceeds the predetermined retracting force so that the slave piston is biased to the extended position over the limited distance through which the supplemental force acts; and means for temporarily trapping the oil in the fluid cavity so that displacement of the slave piston in the direction of the extended position is maintained due to the incompressibility of the temporarily trapped oil.

2. The brake of claim 1 wherein the limited distance over which the supplemental force applying means operates is sufficient to hold the exhaust valves in a first open position after the valve camshaft has opened the exhaust valves on an initial exhaust stroke during operation of the brake.

3. The brake of claim 2, including a master piston mounted for reciprocal motion within a master cylinder wherein the master cylinder communicates with the fluid cavity, and further including means for pulsing the master piston to displace oil within the fluid cavity to further displace the slave piston beyond the distance over which the supplemental force is applied.

4. The brake of claim 3 wherein the master piston is pulsed at the end of the compression stroke so that the exhaust valves are further opened during the pulse to a second opened position.

5. The brake of claim 1 wherein the limited distance over which the supplemental force-applying means operates is sufficient to eliminate cold clearance between the end of the slave piston and the exhaust valve operating means during operation of the brake.

6. The brake of claim 1 wherein the limited distance over which the supplemental force applying means operates is sufficient to only partially eliminate cold clearance between the end of the slave piston and the exhaust valve operating means during operation of the brake.

7. A compression relief engine brake for internal-combustion engines, comprising:

an engine having an engine oil pump, exhaust valves, a valve camshaft, and means for operating the exhaust valves from the valve camshaft wherein the exhaust valves are biased to a closed position and wherein depression of the exhaust valve operating means opens the exhaust valves;

a fluid cavity for accepting engine oil under engine oil pressure;

means for supplying engine oil under engine oil pressure to the fluid cavity;

a slave piston having a predetermined surface area exposed to the fluid cavity, mounted for reciprocating motion within the fluid cavity, wherein the slave piston has a retracted position defining a maximum clearance between one end of the slave piston and the exhaust valve operating means and an extended position for reducing the clearance between the end of the slave piston and the exhaust valve operating means;

means for biasing the slave piston to the retracted position under a predetermined retracting force sufficient to prevent extension of the slave piston upon application of the oil under engine oil pressure to the predetermined surface area of the slave piston within the fluid cavity;

a forward bias unit for applying a supplemental force over a limited distance to the surface of the slave piston, the forward bias unit having a threaded housing to adjustably contact the predetermined surface of the slave piston to adjust the maximum clearance between the end of the slave piston and the exhaust valve operating means and also having a compression spring applying a supplemental force against a loose tolerance finger having an extendable portion adapted to contact the surface of the slave piston over the limited distance wherein the force exerted by the spring of the forward bias unit is less than the predetermined retracting force but is sufficient to bias the slave piston to the extended position when the engine oil pressure acts on the surface of the slave piston;

means for temporarily trapping engine oil in the fluid cavity so that displacement of the slave piston in the direction of the extended position is maintained due to the incompressibility of the temporarily trapped oil; and means for relieving the engine oil pressure from the fluid cavity when the brake is deactivated.

8. The brake of claim 7 wherein the extendable portion of the loose tolerance finger has a length sufficient to apply the supplemental force over the limited distance to hold the exhaust valves in a first open position after the valve cam shaft has opened the exhaust valves on an initial exhaust stroke during operation of the brake.

9. The brake of claim 8, including a master piston mounted for reciprocal motion within a master cylinder wherein the master cylinder communicates with the fluid chamber, and further including means for pulsing the master piston to displace oil within the fluid chamber to further displace the slave piston beyond the distance over which the supplemental force is applied.

10. The brake of claim 9 wherein the master piston is pulsed at the end of the compression stroke so that the exhaust valves are further opened during the pulse to a second opened position.

* * * * *